US006397032B1

(12) United States Patent
Sakaizawa et al.

(10) Patent No.: US 6,397,032 B1
(45) Date of Patent: May 28, 2002

(54) IMAGE FORMING APPARATUS INCLUDING A DEVELOPER BEARING MEMBER HAVING MULTIPLE LAYERS

(75) Inventors: Katsuhiro Sakaizawa, Shizuoka; Yukihiro Ohzeki, Kanagawa; Manami Sekiguchi, Shizuoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,838

(22) Filed: Sep. 7, 2000

(30) Foreign Application Priority Data

Sep. 10, 1999 (JP) ..... 11-257667

(51) Int. Cl.[7] ..... G03G 15/08
(52) U.S. Cl. ..... 399/286
(58) Field of Search ..... 118/653, 657, 118/658; 399/222, 265, 279, 286; 430/101, 110, 120, 124

(56) References Cited

U.S. PATENT DOCUMENTS 5,021,914 A 6/1991 Tsurunaga et al. ..... 361/19
5,062,385 A * 11/1991 Nishio et al. ..... 399/149
5,095,341 A 3/1992 Yoshida et al.
5,998,080 A * 12/1999 Ohno et al. ..... 430/110
6,006,055 A * 12/1999 Furuya ..... 399/149
6,108,509 A * 8/2000 Okada et al. ..... 399/286

FOREIGN PATENT DOCUMENTS

JP 2-26224 1/1990
JP 3-261978 11/1991
JP 8-73660 3/1996

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

In accordance with the present invention, an image forming apparatus includes an image bearing member for bearing an electrostatic latent image, a charging device for charging the surface of the image bearing member, an electrostatic latent image forming device for forming the electrostatic latent image on the surface of the image bearing member charged by the charging device, a developing device, which includes a developer bearing member for bearing a single component developer, for performing development by bringing the single component developer into contact with the electrostatic latent image to form a visible image, a transfer device for electrostatically transferring the visible image to a transfer member, and a fixing device for fixing the electrostatically transferred visible image on the transfer member. The developer bearing member includes at least a conductive core bar, an electron-conductive layer composed of an elastic body, and an ion-conductive layer.

20 Claims, 7 Drawing Sheets

IMAGE FORMING APPARATUS INCLUDING A DEVELOPER BEARING MEMBER HAVING MULTIPLE LAYERS

BACKGROUND OF THE INVENTION

1. Field of the Invention

The present invention relates to electrophotographic image forming apparatuses used in printers, copying machines, and facsimile machines, and more particularly, to an image forming apparatus including a nonmagnetic single component developing device.

2. Description of the Related Art

As an image forming apparatus using a single component developer, a so-called "contact developing device" in which an image bearing member (also referred to as a photosensitive drum) is brought into contact with a developer bearing member (also referred to as a development roller) has been disclosed, for example, in Japanese Patent Publication No. 2-26224 and Japanese Patent Laid-Open No. 3-261978.

FIG. 5 is a schematic diagram showing an example of a conventional image forming apparatus in which images are formed by a contact developing device using a nonmagnetic single component developer (hereinafter, a developer is also referred to as toner). As shown in FIG. 5, in such an image forming apparatus, there are disposed in the periphery of a photosensitive drum 100, which is an image bearing member rotating in the X direction in the drawing, a charging roller 101 as a primary charging device, an exposure unit 102 as an electrostatic latent image forming device, a developer unit 103 as a developing device, a transfer roller 104 as a transfer device, and a cleaning device 105.

The developer unit 103 includes a development roller 107 which performs development while rotating in the Y direction in the drawing, a feed roller 108 as a toner-feeding means which feeds toner T' for nonmagnetic single component development to the development roller 107 while rotating in the Z direction in the drawing, a development blade 110 which is a toner-regulating means for regulating the amount of the toner T' coated on the development roller 107 as well as the amount of charge, a stirring member 109 for feeding the toner T' to the feed roller 108 and stirring the toner T', etc.

In the contact developing device using the rigid photosensitive drum 100 which is brought into contact with the development roller 107 so as to perform development, the development roller 107 is preferably provided with an elastic body.

Conventionally, as the development roller 107 provided with the elastic body, an elastic development roller with a so-called "single solid layer" is used in which a silicone rubber or a nitrile-butadiene rubber (NBR) is formed on a metallic core bar. As the development blade 110, a development blade is generally used formed of a thin plate composed of a stainless steel or the like to which a rubber member composed of a polyurethane rubber or the like is attached at the section abutting on the development roller 107.

Next, the image formation operation of the image forming apparatus will be described.

In response to a print signal from the outside, the photosensitive drum 100 starts to rotate in the X direction. First, the photosensitive drum 100 is uniformly charged by the charging roller 101. Next, an electrostatic latent image is formed on the photosensitive drum 100 due to exposure by the exposure unit 102, and the electrostatic latent image reaches the section which is in contact with the developer unit 103 when the photosensitive drum 100 is rotated.

In connection with the above operation, the developer unit 103 performs an operation described below.

The toner T' stirred by the stirring member 109 is fed onto the development roller 107 due to sliding friction between the development roller 107 rotating in the Y direction and the feed roller 108 rotating in the Z direction. A predetermined amount of charge is applied to the toner T' on the development roller 107 and the amount of the toner T' is regulated by the development blade 110, and thus the toner is born on the development roller 107.

When the toner borne on the development roller 107 reaches the section which is in contact with the photosensitive drum 100, i.e., a development section, a developing bias is applied to the development roller 107 by a power source (not shown in the drawing), and thus the electrostatic latent image formed on the photosensitive drum 100 is developed by the toner T' borne on the development roller 107 so as to become visible. The toner which is not used for development and which remains on the surface of the development roller 107 is recovered by the developer unit 103 via the feed roller 108.

The toner on the photosensitive drum 100 reaches the section opposite to the transfer roller 104 due to the rotation of the photosensitive drum 100, and is transferred to a sheet of transfer paper P'. The toner T' on the transfer paper P' is subjected to thermofusion fixing by the fixing device 106, and thus a permanent image is produced.

The remaining toner T' which is not transferred to the transfer paper P' is recovered by the cleaning device 105.

By repeating the operation described above, the image formation is repeated.

However, there are problems as described below depending on the characteristics of the development roller.

(1) Development Roller Having Electron Conduction System

When a silicone rubber is used as the development roller, a predetermined resistance of the development roller is obtained by dispersing carbon particles or metal particles into the silicone rubber. Such a conduction mode in which a predetermined resistance is obtained by dispersed particles is generally referred to as an electron conduction system. However, when a development roller having the electron conduction system with a low resistance of approximately $1\times10^4$ Ω is used, development characteristics become binary and it is not possible to obtain desired tone characteristics. Although the binary development characteristics are advantageous for text images (i.e., linear images), they are disadvantageous for photographic images (i.e., picture images) because it is impossible to reproduce images with highlights.

As described above, in the development roller having the electron conduction system, it is difficult to obtain satisfactory tone reproduction in output images.

On the other hand, in a development roller with a high resistance of $1\times10^6$ Ω or more, tone characteristics with gentle gradation can be obtained. However, if the resistance is increased in the development roller having the electron conduction system, for reasons which are not yet clear, when the longitudinal image width is changed, the density of the developed image varies even for the same latent image condition, which is disadvantageous. Such a phenomenon is noticeable, particularly in an image with highlights having a low density. Although a desired density can be obtained when the image width is narrow, it is not possible to obtain the desired density when the image width is wide. That is, when an image with highlights is output in the full longitudinal width, it is not possible to obtain a desired density.

Additionally, with respect to the electron conduction system, when an applied voltage is low, the resistance of the elastic body is increased, and in an extreme state, the resistance may vary by 3 orders of magnitude or more, resulting in difficulty in forming a desired image.

(2) Development Roller Having Ionic Conduction System

In a development roller, by adding an ion-conductive agent to an NBR, a polyurethane rubber, or the like so that the material itself is ionized to form a conductive path, a predetermined resistance of the development roller is obtained. Such a conduction system based on the movement of ions is generally referred to as an ionic conduction system. When a development roller having the ionic conduction system is used, in a manner differing from that of the development roller having the electron conduction system, a substantially constant resistance is obtained in response to an applied voltage. Therefore, the ionic conduction system is advantageous over the electron conduction system in the case of the formation of an image having gradation such as a picture image.

However, in the ionic conduction system, since a current path is generated by the ionization of the material, the degree of ionization differs depending on the environment. Under high temperature and high humidity conditions, the resistance of the development roller is decreased, while under low temperature and low humidity conditions, the resistance of the development roller is increased.

Consequently, since the amount of current flowing into the development roller differs depending on the change in environment, under high temperature and high humidity conditions, the density of the image is increased and the overall image becomes dark. Under low temperature and low humidity conditions, the density of the image is decreased and the overall image becomes too light.

In this way, in the development roller having the ionic conduction system, the density of the image varies with environmental conditions, and thus it is difficult to obtain a stable image density.

As described above, it is difficult to obtain desired gradation in the development roller with a single layer having the electron conduction system or the ionic conduction system.

Furthermore, recently, for space-saving purposes, various types of image forming apparatuses employing a cleanerless system which does not include a cleaning member, which mainly cleans a developer remaining on the surface of a photosensitive drum after the transfer process, have been proposed. As one such image forming apparatus, an apparatus employing a "development-and-cleaning" system has been proposed in which a charging roller is brought into contact with a photosensitive drum by means of conductive particles to charge the photosensitive drum, a development roller and the photosensitive drum are disposed so as to abut each other, and in the development process, development is performed using a developer containing the conductive particles and the photosensitive drum is also cleaned.

However, when the above-mentioned image forming apparatus is used under high temperature and high humidity conditions, an electrostatic latent image is sometimes disturbed at the abutting section between the development roller and the photosensitive drum. Such a phenomenon occurs because the development roller to which a voltage is applied abuts on the photosensitive roller, and therefore charge injection occurs by means of the conductive particles at the abutting section between the photosensitive drum and the development roller, and the potential in the exposed section is partially changed. Consequently, in an image with highlights, etc., unevenness may occur in the image and a desired image density may not be obtainable.

Additionally, although Japanese Patent Laid-Open No. 8-73660 discloses a conductive roll provided with a conductive elastic layer, which contains carbon black and an ion-conductive agent, on the surface, it does not describe that the conductive roll is used as a development roller for contact-charging.

SUMMARY OF THE INVENTION

The present invention has been made to overcome the problems described above. It is an object of the present invention to provide an image forming apparatus in which the density is not affected by the image width and an image having superior tone characteristics can be produced even under high temperature and high humidity or low temperature and low humidity conditions. It is another object of the present invention to provide an image forming apparatus in which unevenness in images does not occur and a satisfactory image can be formed even in a system where an image bearing member and a developer bearing member are in contact with each other. It is another object of the present invention to provide an image forming apparatus which can form a high-resolution image even when the "development-and-cleaning" system is employed.

In accordance with the present invention, an image forming apparatus includes an image bearing member for bearing an electrostatic latent image, a charging device for charging the surface of the image bearing member, an electrostatic latent image forming device for forming the electrostatic latent image on the surface of the image bearing member charged by the charging device, a developing device, which includes a developer bearing member for bearing a single component developer, for performing development by bringing the single component developer into contact with the electrostatic latent image to form a visible image, a transfer device for electrostatically transferring the visible image to a transfer member, and a fixing device for fixing the electrostatically transferred visible image on the transfer member. The developer bearing member includes at least a conductive core bar, an electron-conductive layer composed of an elastic body, and an ion-conductive layer.

Further objects, features and advantages of the present invention will be apparent from the following description of the preferred embodiments with reference to the attached drawings.

DESCRIPTION OF THE PREFERRED EMBODIMENTS

An embodiment of the present invention will be described in detail with reference to the drawings.

(1) Developer Bearing Member

A developer bearing member in an image forming apparatus of the present invention includes at least an electron-conductive layer composed of an elastic body and an ion-conductive layer.

Preferably, the developer bearing member in the image forming apparatus of the present invention includes the electron-conductive layer on a conductive core bar, and the ion-conductive layer on the electron-conductive layer.

The image forming apparatus of the present invention forms an image by contact development in which development is performed while a developer borne by the developer bearing member is in contact with an image bearing member.

Figure 1:
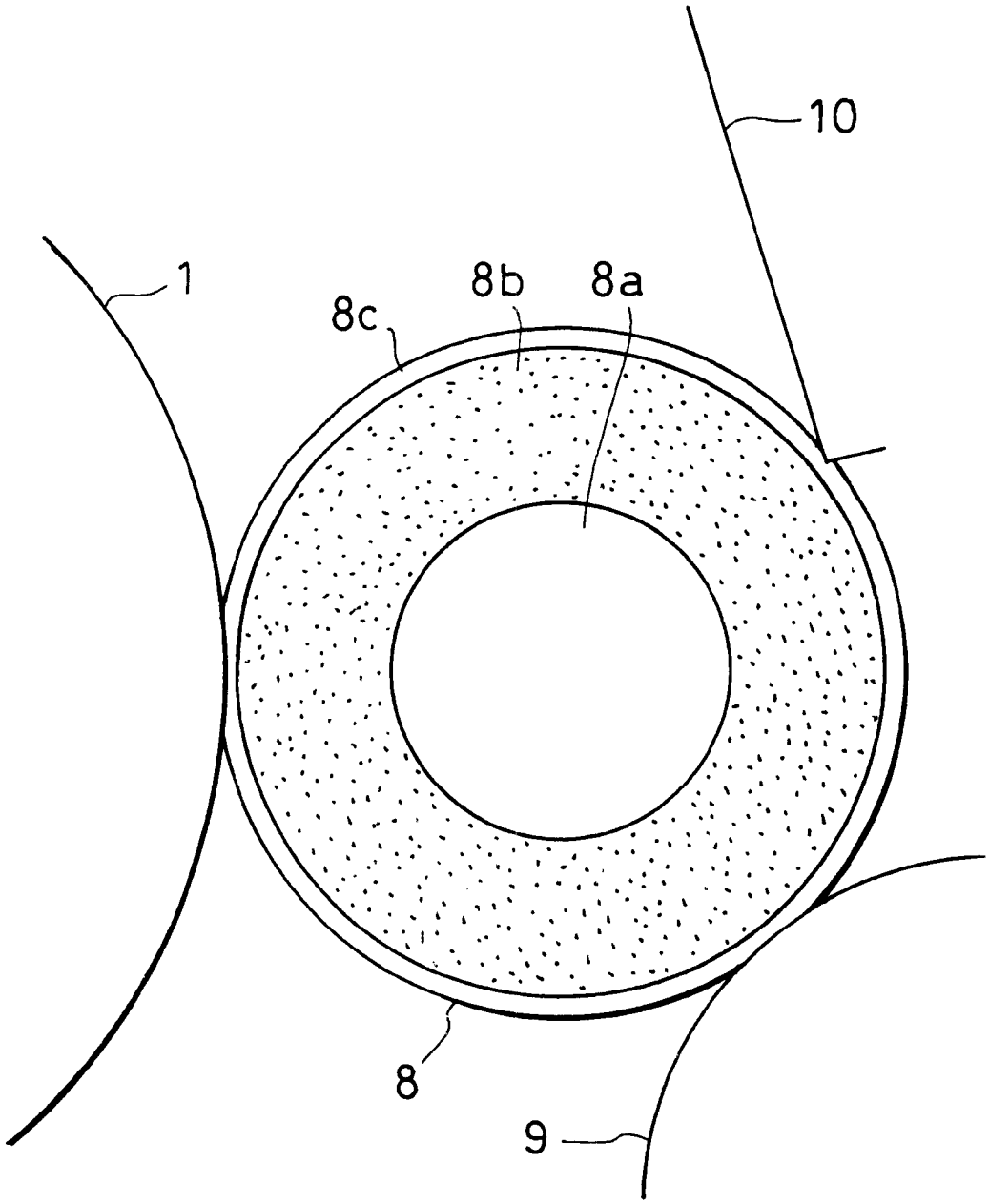
FIG. 1 is a sectional view which schematically shows a developer unit according to an embodiment which may be applied in an image forming apparatus of the present invention.

FIG. 1 is a partial sectional view of a developing device (hereinafter referred to as a developer unit) including a developer bearing member 8 (hereinafter referred to as a development roller). The development roller 8 is a so-called elastic development roller which includes an elastic layer on a core bar. That is, the development roller 8 includes an electron-conductive layer 8*b* on a conductive core bar 8*a*, and an ion-conductive layer 8*c* on the electron-conductive layer 8*b*. In FIG. 1, numeral 1 represents an image bearing member, numeral 9 represents a feed roller, and numeral 10 represents a development blade.

In the present invention, as the conductive core bar, a known core bar composed of a stainless steel, iron, aluminum, or the like is used.

The electron-conductive layer used in the development roller of the present invention is composed of an elastic body in which a conductivity-imparting agent having electron conductivity is dispersed. As the elastic body, a commonly used rubber, such as a silicone rubber, a butyl rubber, a natural rubber, an acrylic rubber, an EPDM (ethylene-propylene copolymer), or a mixture thereof, may be used.

As the conductivity-imparting agent having electron conductivity, carbon resin particles or metal particles may be used. By using the above-mentioned rubber as the elastic body and dispersing the above-mentioned conductivity-imparting agent having electron conductivity thereinto, a predetermined resistance can be obtained in the development roller. The content of the conductivity-imparting agent is preferably 3 to 40 parts by mass, and more preferably, 5 to 25 parts by mass, relative to 100 parts by mass of the elastic body.

As the electron-conductive layer a silicone rubber having carbon black dispersed therein is preferably used. This is because if the elastic body is formed using the silicone rubber, the hardness is easily decreased in the solidified form, and the carbon black is satisfactorily dispersed.

Although it may be possible to decrease the hardness in a foamed material, when a surfacing material is applied, foaming cells must be sealed by a known method, resulting in an increase in the number of fabrication steps. Thus, the hardness is preferably decreased in the solidified form.

The ion-conductive layer used in the development roller of the present invention is composed of a resin binder into which a conductivity-imparting agent having ionic conductivity is dispersed.

By dispersing the conductivity-imparting agent having ionic conductivity, such as lithium perchlorate or a quaternary ammonium salt, into the resin binder, the ion-conductive layer 8*c* can be formed. Other examples of the conductivity-imparting agent having ionic conductivity (ion-conductive agent) are salts of a metal of group 1 of the periodic table, such as Li, Na, or K, e.g., $LiCF_3SO_3$, $NaClO_4$, $LiClO_4$, $LiAsF_6$, $LiBF_4$, NaSCN, KSCN, and NaCl, electrolytes such as ammonium salts or salts of a metal of group 2 of the periodic table, such as Ca or Ba, e.g., $Ca(ClO_4)_2$, and complexes comprising the salts and polyhydric alcohols, such as 1,4-butanediol, ethylene glycol, polyethylene glycol, propylene glycol, and polyethylene glycol, or derivatives thereof, or complexes comprising the salts and monools, such as ethylene glycol monomethyl ether and ethylene glycol monoethyl ether.

As the resin binder of the ion-conductive layer, when negatively charged toner is used, a polyurethane resin, a silicone resin, or a polyamide resin is preferably used.

When positively charged toner is used, a fluorine-containing resin is preferably used. Furthermore, in order to impart elasticity similar to that of the electron-conductive layer, a soluble rubber may be mixed into the resin.

In the ion-conductive layer of the present invention, preferably, 0.1 to 2 parts by mass of the ion-conductive agent is dispersed into 100 parts by mass of the resin binder. If the content of the ion-conductive agent is less than 0.1 parts by mass, conductivity may not be exhibited, and if the content exceeds 2 parts by mass, the resistance in the surface layer may change greatly with environmental conditions.

Preferably, the ion-conductive layer has a coating thickness of 3 to 50 $\mu$m. If it is less than 3 $\mu$m, abrasion may occur due to sliding friction between the ion-conductive layer and the photosensitive drum, and in order to obtain the thickness exceeding 50 $\mu$m, coating must be performed repeatedly, which is not practical for manufacture thereof. In view of stabilizing changes due to environmental conditions, the thickness is more preferably 5 to 30 $\mu$m.

In the development roller of the present invention, the elastic body having an Asker C hardness of 35 to 55 degrees is preferably used. If the Asker C hardness exceeds 55 degrees, the toner may be melted due to sliding friction of the development roller, resulting in fusion of the blade and fusion of the roller, which is disadvantageous. Additionally, the abutting state between the development roller and the photosensitive drum easily becomes unstable. If the Asker C hardness is less than 35 degrees, permanent deformation due to compression set results in a difficulty in use as the development roller. More preferably, the Asker C hardness is 35 to 45 degrees, and by setting the hardness in such a low range, even in an image forming apparatus in which the development roller and the photosensitive drum are in contact with each other, such as in the present embodiment, triboelectrification is possible without applying excessive stress on the toner.

Additionally, in order to set the hardness of the elastic body of the development roller so as to be in the range described above, for example, in the case of a silicone rubber, the content of a plasticizer is adjusted. As the plasticizer, for example, organopolysiloxane having a relatively low molecular weight may be used. That is, if the amount of the plasticizer is decreased, the hardness of the elastic body increases, and if the amount of the plasticizer is increased, the hardness of the elastic body decreases.

The hardness of the elastic body can be measured using an Asker C rubber hardness tester (manufactured by Kobunshi Keiki Co., Ltd.).

With respect to the surface roughness of the development roller in the present invention, the ten-point average roughness Rz is preferably 3 to 15 μm, although it depends on the particle size of toner used. If the toner used has a volume-average particle size of approximately 6 μm, the ten-point average roughness Rz is preferably 5 to 12 μm. If the particle size of the toner is smaller than the above, it is preferable that the ten-point average roughness Rz be slightly decreased. If the ten-point average roughness is less than 3 μm, the ability to convey toner may be insufficient and insufficient copy density may occur. If it is more than 15 μm, the toner may be insufficiently charged, resulting in adhesion of the toner to the non-image section, i.e., so-called "fogging".

The surface roughness of the development roller may be set to be within the range described above, for example, by changing the ground state of the surface of the electron-conductive layer. That is, if the surface of the electron-conductive layer composed of a silicone rubber is ground rough, the surface roughness of the ion-conductive layer coated thereon is increased, and if the surface of the electron-conductive layer is ground smooth, the surface roughness of the ion-conductive layer is decreased.

With respect to the ten-point average roughness Rz, the definition provided in JIS B0601 is used, and can be measured using a surface roughness tester SE-30H manufactured by Kosaka Laboratory Ltd.

In the present invention, with respect to the resistance of the development roller, the resistance of the ion-conductive layer which is the surface layer is preferably set to be higher than the resistance of the electron-conductive layer which is the lower layer because a change in resistance with environmental conditions can be easily controlled. Furthermore, by setting the resistance of the ion-conductive layer to be higher than that of the electron-conductive layer and also by forming the ion-conductive layer so as to be thin, the change in resistance with environmental conditions, which is a shortcoming of the ionic conduction system, can be further decreased.

That is, in the electron-conductive layer 8*b*, the voltage dependence of the resistance (an increase in resistance in the low voltage region) occurs as the resistance is increased, it is preferable that the resistance of the electron-conductive layer is maintained low. Thus, the voltage dependence can be decreased. By increasing the resistance of the ion-conductive layer as the surface layer, the resistance of the entire developer bearing member is preferably adjusted by the ion-conductive layer.

Since the ion-conductive layer is formed so as to be thin, even if the environmental conditions change, variations in resistance can be minimized. In this manner, by functionally separating the individual layers of the development roller, an image with highlights can be faithfully reproduced without being affected by the environment and without a change in image density with the image width.

The resistance is determined by a resistance measurement method described below. The electron-conductive layer preferably has a resistance of $1\times10^3$ to $1\times10^5$ Ω. and more preferably, $5\times10^3$ to $7\times10^4$ Ω. If it is less than $1\times10^3$ Ω, leakage may occur when the photosensitive drum on which the development roller abuts has a defect. If it is more than $1\times10^5$ Ω, the voltage dependence of the development roller is increased and an increase in resistance in the low voltage region may occur.

By adjusting the amount of the conductivity-imparting agent having electron conductivity in the elastic body, the resistance described above can be imparted to the electron-conductive layer. That is, if the content of the conductivity-imparting agent having electron conductivity in the elastic body is increased, the resistance is decreased, and if it is decreased, the resistance is increased.

The resistance of the ion-conductive layer substantially corresponds to the resistance of the development roller. Therefore, the development roller preferably has a resistance of $5\times10^5$ to $1\times10^9$ Ω. more preferably, $1\times10^6$ to $1\times10^9$ Ω. further preferably, $1\times10^6$ to $5\times10^8$ Ω. and even more preferably, $1\times10^6$ to $5\times10^7$ Ω.

By adjusting the amount of the conductivity-imparting agent having ionic conductivity in the resin, the resistance described above can be imparted to the ion-conductive layer. That is, if the content of the conductivity-imparting agent having ionic conductivity is increased, the resistance is decreased, and if it is decreased, the resistance is increased.

Preferably, the difference in resistance between the development roller and the electron-conductive layer (before the formation of the ion-conductive layer) is 2 orders of magnitude ($1\times10^2$ Ω) or more. If it is less than 2 orders of magnitude, since the resistance of the electron-conductive layer is increased in the low voltage region as described above, which affects the resistance of the development roller, the resistance of the development roller in the low voltage region may be increased. Furthermore, if it is less than 2 orders of magnitude, since the resistance of the development roller becomes $1\times10^6$ Ω, an image with desired tone reproducibility may not be obtainable.

In order to measure the resistance of the development roller, a method described below may be used.

In an environment at 25° C./55% RH, the development roller is abutted on a cylindrical aluminum conductor having a diameter of 30 mm from above. At this stage, a weight providing a load of 500 g is provided on each end of the development roller. Simultaneously, in order to set the amount of penetration to the cylindrical aluminum conductor at 50 μm, i.e., in order to maintain the constant abutting section between the development roller and the cylindrical aluminum conductor, a cylindrical penetration-holding member having an outer diameter which is smaller than the outer diameter of the development roller by 100 μm is fixed into each end of the development roller. With an ammeter and a high voltage power supply being connected to the development roller, a voltage is applied.

When the cylindrical aluminum conductor is rotated at approximately 50 mm/sec, the development roller is also rotated following the cylindrical aluminum conductor, and in this state, the voltage is applied and the resistance is calculated based on the measured value of the ammeter.

In the present invention, the voltage applied for measuring resistance is set at 30 V for the electron-conductive layer and is set at 100 V for the entire development roller. With respect to the measurement of the resistance for the electron-conductive layer, since the electron-conductive layer has a low resistance, if the applied voltage exceeds 30 V, the voltage easily becomes out of range. With respect to the measurement of the resistance for the entire development roller, since the development roller has a higher resistance than that of the electron-conductive layer, a change in resistance in the low voltage range is increased, and the change in resistance is decreased at approximately 100 V or more.

(2) Method of Fabricating Developer Bearing Member (development roller)

An example of a method of fabricating the development roller in the present invention will be described below.

An adhesive for ensuring the adhesion and conductivity of a rubber is applied on a core bar. An electron-conductive rubber which is an electron-conductive layer having a conductive agent dispersed therein is wound around the core bar, which is placed in a mold. Heat and pressure are applied to the mold by a press to perform vulcanization, and the surface is ground after vulcanization, and thus a solid elastic roller is obtained. In order to form an ion-conductive layer, an ion-conductive agent is dispersed in a coating binder, and then roll coating, spraying, dipping, or the like is performed. As described above, preferably, the ion-conductive layer has a thickness of 3 to 50 $\mu$m.

(3) Developer

In the present invention, a nonmagnetic single component developer (hereinafter, also referred to as toner) contains toner particles containing at least a binder resin as a principal ingredient, and additives, such as a coloring agent, a wax composition, and a charge control agent, as required, as well as an external additive.

Examples of the binder resin used for the toner particles in the present invention are homopolymers containing styrene or a styrene substitute, such as polystyrene and polyvinyltoluene; styrene-based copolymers, such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate copolymers; and miscellaneous resins, e.g., polymethyl methacrylate, polybutyl methacrylate, polyvinyl acetate, polystyrene, polypropylene, polyvinyl butyral, silicone resins, polyester resins, polyamide resins, epoxy resins, polyacryresinesins, rosins, modified rosins, terpene resins, phenolic resins, aliphatic resins or aliphatic polycyclic hydrocarbon resins, and aromatic petroleum resins. These resins may be used alone or in combination.

With respect to the toner particles of the present invention, in cross-sectional observation of toner particles using a transmission electron microscope (TEM), the wax composition is preferably dispersed, without being dissolved into the binder resin, substantially in the form of a spherical and/or spindle-shaped island, i.e., the toner particles have a so-called "core/shell structure". By dispersing the wax composition as described above so as to be enclosed in the toner particles, deterioration of the toner particles and contamination of the image forming apparatus can be prevented, and thus satisfactory charging characteristics are maintained, and toner images having excellent dot reproducibility can be formed for a long period of time. Also, since the wax composition acts efficiently when heated, satisfactory low-temperature fixing performance and offset resistance can be obtained.

In the present invention, in order to observe cross sections of toner particles, specifically, toner particles are thoroughly dispersed in a cold-setting epoxy resin, followed by curing for 2 days at 40° C., and then the resulting cured substance is dyed using ruthenium tetroxide and optionally in combination with osmium tetroxide. Thin sections are then cut out by a microtome provided with a diamond cutting edge, and the cross sections of the toner particles are observed using a transmission electron microscope (TEM). In the present invention, a ruthenium tetroxide staining technique is preferably used in order to enhance the contrast between materials using a slight it difference in crystallinity between the wax composition constituting the core and the binder resin constituting the shell.

Figure 3A:
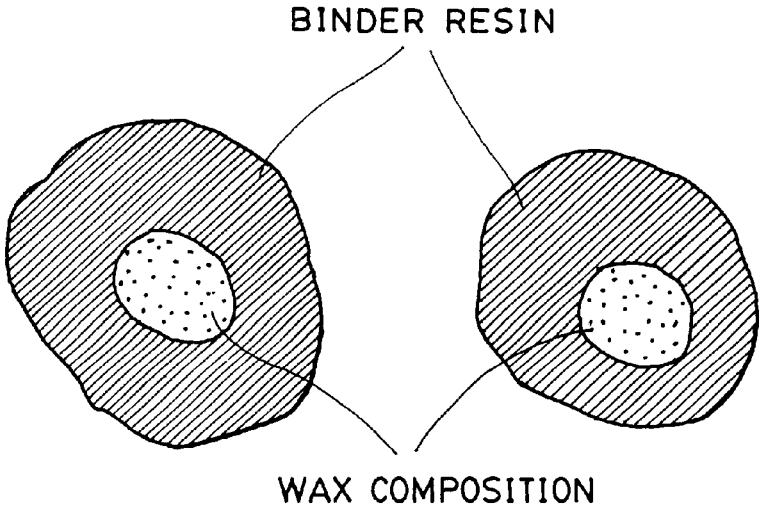
FIGS. 3A and 3B are schematic diagrams which show cross sections of toner particles having a core/shell structure.
Figure 3B:
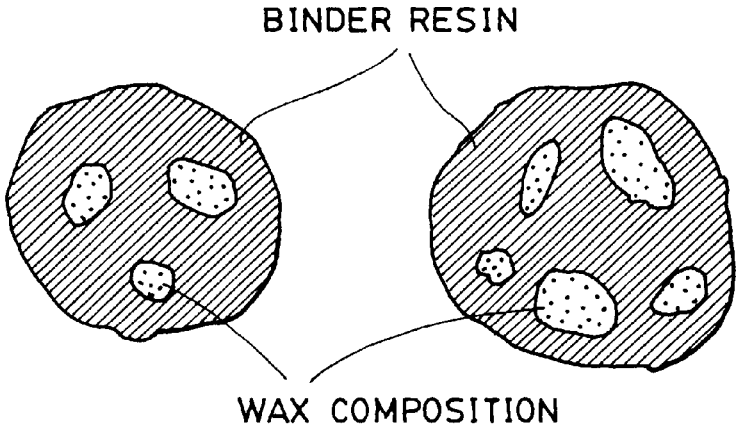

FIGS. 3A and 3B are schematic diagrams which show cross sections of toner particles having a core/shell structure. As shown in FIGS. 3A and 3B, with respect to the toner particles used in the present invention, preferably, the wax composition is enclosed in the binder resin.

The wax composition which is a principal constituent of the core preferably has a maximum endothermic peak in the range from 40 to 130° C. when the temperature is raised with respect to the DSC curve measured by a differential scanning calorimeter.

If the wax composition has a maximum endothermic peak in the temperature range described above, low-temperature fixing is easily allowed and the releasability is effectively exhibited. If the maximum endothermic peak is less than 40° C., the ability of the wax composition to aggregate by itself may be weakened, and consequently, the high-temperature offset resistance is decreased, resulting in excessively high gloss.

On the other hand, if the maximum endothermic peak exceeds 130° C., the fixing temperature is increased, and it may become difficult to properly smooth the surface of the fixed image. Thus, in particular, when the wax component is used for color toner particles, color mixing characteristics may be degraded, which is disadvantageous. Furthermore, when toner particles are directly obtained by a polymerization method in which granulation and polymerization are performed in an aqueous medium, if the maximum endothermic peak is high, the wax composition may be precipitated mainly in the granulation process.

The maximum endothermic peak of the wax composition can be measured according to "ASTM D 3418-8", using DSC-7 manufactured by PerkinElmer Inc. In order to correct the temperature of the detecting element in the apparatus, melting points of indium and zinc are used, and in order to correct heat quantities, heat of fusion of indium is used. In order to measure the sample, an aluminum pan is used, and an empty pan is set for comparison. After taking a previous history record by raising and lowering the temperature once, measurement is carried out at a temperature increase rate of 10° C./min.

Specifically, examples of the wax composition to be used include paraffin waxes, polyolefin waxes, Fischer-Tropsh waxes, amide waxes, higher fatty acids, ester waxes, and derivatives thereof, or graft/block compounds thereof.

In the present invention, preferably, the toner particles are substantially spherical.

Also, preferably, the toner particles used in the present invention have a shape factor SF-1 of 100 to 160 and a shape factor SF-2 of 100 to 140 measured by an image analyzer, and more preferably, the toner particles have a shape factor SF-1 of 100 to 140 and a shape factor SF-2 of 100 to 120. By satisfying the above requirements and by setting the ratio (SF-2)/(SF-1) at 1.0 or less, the characteristics of the toner particles are improved and also satisfactory matching with the image analyzer can be obtained.

The shape factors SF-1 and SF-2 used in the present invention are obtained by sampling at random 100 toner images magnified 500 times with a scanning electron microscope FE-SEM (S-800) manufactured by Hitachi Ltd., inputting the image information into an image analyzer Luzex III manufactured by Nireco K.K. through an interface, and calculating the analyzed data according to the equations below.

$$SF\text{-}1=\{(MXLNG)^2/AREA\}\times(\pi/4)\times100$$

$$SF\text{-}2=\{(PERI)^2/AREA\}\times(1/4\pi)\times100$$

where AREA is a projected area of a toner particle, MXLNG is an absolute maximum length, and PERI is a peripheral length.

The shape factor SF-1 of the toner particle represents a degree of roundness, and as the value increases, the particle becomes less spherical and more amorphous. The shape factor SF-2 represents a degree of unevenness of the toner particle, and as the value increases, the unevenness of the surface of the toner particle increases.

If the shape factor SF-1 exceeds 160, since the shape of the toner particle is amorphous, adhesion of the toner to the development roller may be increased. In such a case, the toner may be unsuitable for outputting an image with highlights. As the toner particle becomes more spherical, since adhesion of the toner to the development roller is decreased, a very small latent image is easily reproduced, and thus an image with highlights can be reproduced more satisfactorily.

Preferably, the toner particle has a shape factor SF-2 of 100 to 140, and the ratio (SF-2)/(SF-1) is 1.0 or less. If the shape factor SF-2 of the toner particle exceeds 140 and the ratio (SF-2)/(SF-1) exceeds 1.0, the surface of the toner particle becomes rough and the toner particle tends to have a great amount of unevenness, and also adhesion the toner may be increased. Thus, the reproducibility of an image with highlights may be degraded.

Furthermore, in order to faithfully develop very small latent image dots for improving image quality, the toner preferably has a weight-average particle size of 10 μm or less, more preferably, 4 to 8 μm, and the coefficient of variation A in number distribution of the toner is preferably 35% or less. If the weight-average particle size of the toner exceeds 10 μm, fusion onto the surface of the photosensitive drum easily occurs, and the reproducibility of very small dots is degraded. If the coefficient of variation in number distribution of the toner exceeds 35%, the above tendency is further increased. If the weight-average particle size of the toner is less than 4 μm, nonuniformity in image due to an increase in charge of the toner easily occurs, and thus such a toner is unsuitable for use in the present invention.

The particle size distribution of the toner may be measured by various methods. In the present invention, a Coulter counter may be used. For example, a Coulter counter Model TA-II (manufactured by Coulter Electronics, Inc.) may be used as a measuring device, to which an interface (manufactured by Nikkaki) and a personal computer for outputting number distribution and volume distribution are connected, and by using extra-pure sodium chloride, a 1% NaCl aqueous solution as an electrolytic solution is prepared. As the 1% NaCl aqueous solution, for example, ISOTON II (produced by Coulter Scientific Japan Co., Ltd.) may be used.

Measurement is carried out by adding 0.1 to 5 ml of a surfactant, preferably, an alkylbenzene sulfonate, as a dispersant, to 100 to 150 ml of the electrolytic solution, and 2 to 20 mg of a sample to be measured is further added thereto. The electrolytic solution in which the sample is suspended is subjected to dispersion treatment for approximately 1 to 3 minutes by an ultrasonic dispersion machine. Using, for example, an aperture of 100 μm in the Coulter counter Model TA-II, the particle size distribution for particles of 2 to 40 μm on a numerical basis is measured, and then the value in accordance with the present invention is obtained.

The coefficient of variation A of number distribution of toner particles is calculated according to the equation below.

$$\text{Coefficient of variation } A=[S/D_1]\times100$$

where S is the value of the standard deviation in the number distribution of toner particles, and $D_1$ is a number-average particle size (μm) of the toner particles.

Furthermore, in the toner used in the present invention, preferably, the surface of the toner particle is coated with an external additive so that a predetermined amount of charge is applied to the toner.

For that purpose, the surface of the toner particle preferably has an external additive coating ratio of 5 to 99%, and more preferably, 10 to 99%.

The external additive coating ratio of the surface of the toner particle may be measured in the method described below. Using a scanning electron microscope FE-SEM (S-800) manufactured by Hitachi Ltd., 100 toner images are sampled at random, and the image information is input into an image analyzer Luzex III manufactured by Nireco K.K. through an interface. The resulting image information is binary since there is a difference in brightness between the surface of the toner particle and the external additive section, and the area SG of the external particle section and the area ST of the toner particle (including the area of the external additive section) are separated, and then the external additive coating ratio is calculated according to the equation below.

$$\text{External additive coating ratio } (\%)=(SG/ST)\times100$$

The external additive used in the present invention preferably has a particle size that is one-tenth or less of the weight-average particle size of the toner particle in view of durability when added to the toner. The particle size of the additive means the average particle size determined by observation of the surface of the toner particle with an electron microscope.

Examples of the external additive are metal oxides, such as aluminum oxide, titanium oxides, strontium titanate, cerium oxides, magnesium oxide, chromium oxides, tin oxides, and zinc oxide; nitrides, such as silicon nitride; carbides, such as silicon carbide; metal salts, such as calcium sulfate, barium sulfate, and calcium carbonate; metal salts of fatty acids, such as zinc stearate and calcium stearate; carbon black; silica; Teflon powder; and polyvinylidene fluoride powder.

The content of the external additive used is 0.01 to 10 parts by mass relative to 100 parts by mass of the toner particles, and preferably, 0.05 to 5 parts by mass. Such external additives may be used alone or in combination. More preferably, the external additives used are subjected to hydrophobic treatment.

In order to obtain the toner particles having the external additive coating ratio described above, a method of mixing and stirring using a mixing device, such as a Henschel mixer, may be used.

If the content of the external additive is less than 0.01 part by mass, the flowability of the toner is decreased, and the individual toner particles may not be triboelectrified, resulting in a decrease in charging characteristics imparted to the toner and an increase in adhesion of the toner to non-image sections, i.e., so-called "fogging". On the other hand, if the content of the external additive exceeds 10 parts by mass, the surplus external additive may adhere to the photosensitive drum and the development roller, thus decreasing charging characteristics imparted to the toner or disturbing the image.

With respect to the toner used in the present invention, preferably, a charge control agent is mixed in (internally added to) the toner particles, or mixed with (externally added to) the toner particles. The charge control agent allows the optimum control of the amount of charge in accordance with the developing device.

Examples of charge control agents for negatively charged toners include organometallic complexes and chelated compounds, such as monoazo metal complexes, acetylacetone metal complexes, metal complexes of aromatic hydroxycarboxylic acids, and metal complexes of aromatic dicarboxylic acids. Other examples are aromatic hydroxycarboxylic acids, aromatic monocarboxylic and polycarboxylic acids, and metal salts, anhydrides, and esters thereof; and phenol derivatives, such as bisphenol.

Examples of charge control agents for positively charged toners include nigrosine and nigrosine modified with a metal salt of a fatty acid; metal salts of higher fatty acids, such as quaternary ammonium salts, e.g., tributylbenzylammonium-1-hydroxy-4-naphthosulfonate and tetrabutylammonium tetrafluoroborate, onium salts such as phosphonium salts, and lake pigments thereof, and triphenylmethane dyes and lake pigments thereof (laking agents include phosphotungstic acid, phosphomolybdic acid, phosphotungstomolybdic acid, tannic acid, lauric acid, gallic acid, ferricyanides, and ferrocyanides); diorganotin oxides, such as dibutyltin oxide, dioctyltin oxide, and dicyclohexyltin oxide; and diorganotin borates, such as dibutyltin borate, dioctyltinborate, and dicyclohexyltin borate. These compounds may be used alone or in combination.

Additionally, within a range that does not substantially adversely affect the toner, small amounts of other known additives, such as lubricant powder, abrasives, agents for imparting flowability, caking-inhibitors, conductivity-imparting agents, colorants, and organic particulates and inorganic particulates having reversed polarity, may be used as development improvers.

Preferably, the toner particles in the present invention are partially or entirely produced by a polymerization method.

In the polymerization method, toner particles are produced by enclosing the charge control agent, etc. in polymer particles in the polymerization process in which monomers of a binder resin are formed into a polymer.

When toner particles used in the image forming apparatus in accordance with the present invention are produced by suspension polymerization, in general, a monomer system is used, in which essential ingredients of the toner particles, such as a wax composition, a plasticizer, a charge control agent, a crosslinking agent, and optionally, a colorant, etc. and other additives, such as an organic solvent for decreasing the viscosity of the polymer formed by the polymerization, a high-molecular-weight polymer, a dispersant, etc. are appropriately added to a polymerizable monomer, and homogeneous dissolution or dispersion is carried out by a dispersion machine, such as a homogenizer, a ball mill, a colloid mill, or an ultrasonic dispersion machine, and the monomer system is suspended in an aqueous medium containing a dispersion stabilizer. In such a case, if a high-speed dispersion machine, such as a high-speed mixer or an ultrasonic dispersion machine, is used so that the toner particles have the predetermined size quickly, the resulting toner particles have narrower particle size ranges.

A polymerization initiator may be added to the polymerizable monomer simultaneously with the other additives, or may be added immediately before the monomer system is suspended in the aqueous medium. Alternatively, the polymerization initiator which is dissolved in the polymerizable monomer or the solvent may be added immediately after granulation before the polymerization reaction starts.

When the toner particles are produced by suspension polymerization, a known surfactant or organic or inorganic dispersant may be used as the dispersion stabilizer. Above all, the inorganic dispersant is preferably used because of the fact that harmful fine powder is not easily generated, and dispersion stability is secured due to its steric hindrance, and thus stability is not easily lost even if the temperature is changed, and also it is easy to clean and an adverse effect on the toner particles can be substantially prevented.

In the polymerization process, the polymerization temperature is set at 40° C. or more, and generally 50 to 90° C. If the polymerization is carried out in such a temperature range, the wax composition to be enclosed is precipitated due to phase separation; thus, more complete enclosure is possible.

Additionally, toner particles in accordance with the present invention may be produced by dispersion polymerization, in which toner particles are directly formed using a water-based organic solvent which dissolves a monomer and does not dissolve a resulting polymer, or by emulsion polymerization, for example, a soap-free polymerization method, in which toner particles are formed by direct polymerization in the presence of a water-soluble polar polymerization initiator.

Figure 2:
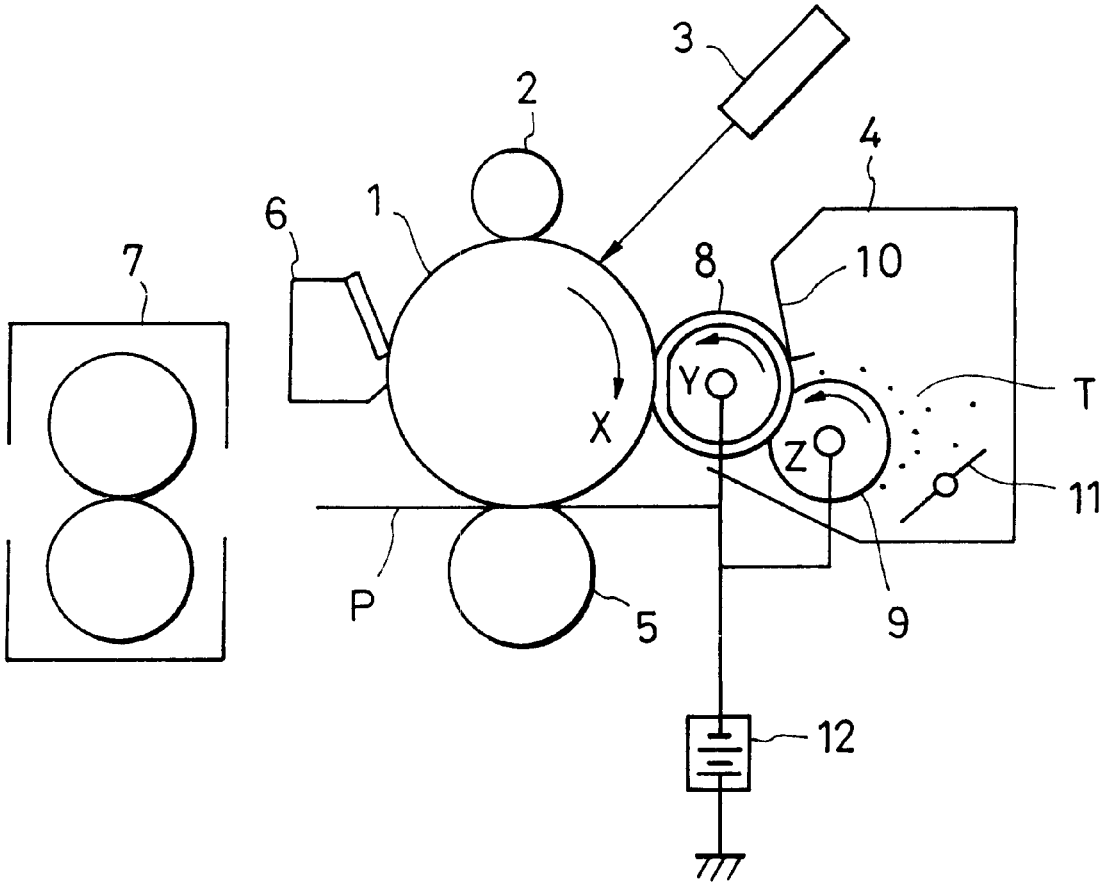
FIG. 2 is a schematic diagram of an image forming apparatus according to an embodiment of the present invention.

An image forming apparatus in an embodiment of the present invention will be described with reference to FIG. 2. However, the present invention is not limited to this. Apart from a development roller and a nonmagnetic single component developer in accordance with the present invention being used, the image forming apparatus may have the same structure as that of a known apparatus.

A charging roller 2 as a primary charging device, is connected to a charging bias power source (not shown in the drawing) so as to uniformly charge the surface of a photosensitive drum 1 which rotates in the X direction. During the image-forming operation, by applying approximately −1,300 V to the charging roller 2, the surface of the photosensitive drum 1 can be uniformly charged at approximately −700 V. The charging roller 2 has a diameter of 12 mm and follows the photosensitive drum 1. An exposure unit 3 as an electrostatic latent image forming device, for example, including a laser or LED, exposes and scans the surface of the photosensitive drum 1 in response to an information signal to form an electrostatic latent image. The potential of the exposed section is approximately −120 V.

In this embodiment, the photosensitive drum 1 has a diameter of 30 mm and rotates in the X direction at a rotational speed $V_x$, which can be set at 103 mm/sec.

A development unit 4 for containing a nonmagnetic single component developer (toner) T includes a development roller 8 of the present invention which is in contact with the photosensitive drum 1 and rotates in the Y direction at a rotational speed $V_y$. The development unit 4 also includes a development blade 10 as a toner-regulating member, a feed roller 9 rotating in the Z direction, and a stirring member 11 for stirring the toner T. With respect to the rotational speed, the photosensitive drum 1 and the development roller 8 have the relationship $V_y>V_x$, preferably, $V_y>1.3V_x$. Herein, the rotational speed $V_y$ is set at 175 mm/sec.

In order to make the toner T of the present invention contained in the development unit 4 adhere to the development roller 8, a certain amount of charge must be applied to the toner T by friction against the feed roller 9 and the development roller 8. As the material for the feed roller 9, a known material, such as an expanded polyurethane rubber or an expanded EPDM rubber is used. In this embodiment, the feed roller 9 composed of the expanded polyurethane rubber is rotated at a rotational speed $V_z$ counter to the development roller 8 in the Z direction. The rotational speed $V_z$ is set at 70 mm/sec. The same potential as that of a development bias power source 12 is applied to the feed roller 9. As the toner in this embodiment, a negatively charged toner is used.

With respect to the toner applied to the development roller 8 by the feed roller 9, the amount of toner is regulated and a triboelectric charge is applied by the development blade 10 as the toner-regulating member. The development blade 10 is composed of a stainless steel sheet with a thickness of 0.1 mm and has leaf-spring elasticity. The development blade 10 is bent in the direction opposite to the development roller 8 at a position approximately 2 mm from the edge, and the development blade 10 is disposed so that the bent section is in contact with the development roller 8 on the downstream side of the rotating direction of the development roller 8. However, the present invention is not limited to this, and an elastic blade, such as a polyurethane rubber blade, may also be used.

With respect to the contact pressure of the development blade, the preferable linear pressure is 15 to 35 g/cm. If it is less than 15 g/cm, the appropriate amount of charge cannot be applied to the toner, and fogging occurs, resulting in a decrease in image quality. If it is more than 35 g/cm, due to the pressure, etc., the external additive mixed with the toner is easily separated from the surface of the toner particle, and thus the toner is deteriorated, resulting in a decrease in charging characteristics of the toner.

Although the development blade described above is composed of a metal, in order to improve the ability to impart charging characteristics to the toner, a resin may be coated on the metallic development blade. As the resin, when a negatively charged toner is used, a polyamide resin is preferably used, and when a positively charged toner is used, a fluorine-containing resin is preferably used.

In order to measure the linear pressure, a stainless steel sheet 100 mm long, 15 mm wide, and 30 $\mu$m thick, as a sheet to be drawn, and a stainless steel sheet 180 mm long, 30 mm wide, and 30 $\mu$m thick, which is folded so as to halve the length, as a fitting strip, are prepared. The fitting strip, into which the sheet to be drawn is inserted, is placed between the development roller 8 and the development blade 10. In such a state, the sheet to be drawn is drawn by a spring scale or the like at a constant speed, and the value (in units of g) of the spring scale is read. By dividing the value of the spring scale by 1.5, the linear pressure in units of g/cm is obtained.

The amount of toner (per unit area) passing through the development blade 10 and supported by the development roller 8 is preferably approximately 0.3 to 0.45 mg/cm$^2$.

The development roller 8 is connected to the development bias power source 12, and the photosensitive drum 1 is grounded. The development bias power source 12 is a negative DC power source and applies a potential of −350 V in this embodiment. Since the potential of the exposed section is −120 V, the development contrast is 230 V. The toner to which charge is applied by the development blade 10 and which is supported on the development roller 8 is fed onto the photosensitive drum 1 by the development bias to develop the electrostatic latent image.

The development bias voltage preferably has a potential difference of 100 to 400 V relative to the potential of the exposed section (−120 V in this embodiment). The potential difference is referred to as development contrast. In this embodiment, a development bias voltage of −220 to −520 V is preferably applied. When the development contrast is set in the above range, the latent image is not disturbed in the development process, and an image with highlights can be reproduced satisfactorily. If the development contrast is less than 100 V, there may be difficulty in transferring the toner to the photosensitive drum 1 in an amount that is sufficient to obtain satisfactory image density. If the development contrast exceeds 400 V, since the potential difference with the potential of the exposed section on the photosensitive drum is decreased, the toner tends to adhere also to the non-image section, resulting in fogging.

When a sheet of transfer paper P, which is conveyed by a conveyer roller (not shown in the drawing) reaches the transfer section, the image formed on the surface of the photosensitive drum 1 is transferred to the transfer paper P by a transfer roller 5. A transfer bias power source (not shown in the drawing) is connected to the transfer roller 5. A voltage of approximately +2 to 5 kV is applied by the transfer bias power source.

The transfer paper P to which the image is transferred is subjected to thermofusion fixing by a fixing device 7. The toner which is not transferred to the transfer paper P and remains on the photosensitive drum 1 is recovered by a cleaning device 6, and the photosensitive drum 1 is used for a next image.

With respect to the abutting pressure of the development roller 8 on the photosensitive drum 1, the preferable linear pressure is 20 to 100 g/cm when measured in a manner similar to that of the measurement of the linear pressure described above. If the linear pressure is less than 20 g/cm, the contact state becomes unstable. If the linear pressure exceeds 100 g/cm, due to the pressure, etc., the external additive mixed with the toner is easily separated from the surface of the toner and the toner is easily deteriorated. In either case, the ability of the development blade 10 to charge the toner is decreased, resulting in an increase in the probability of insufficient charging of the toner. In order to prevent the electrostatic latent image from being disturbed at the abutting section between the development roller and the photosensitive drum, more preferably, the linear pressure is set at 20 to 70 g/cm.

Next, another embodiment of the present invention will be described. The same numeral as that in the previous embodiment is used for the same member, and description thereof will be omitted.

Figure 6:
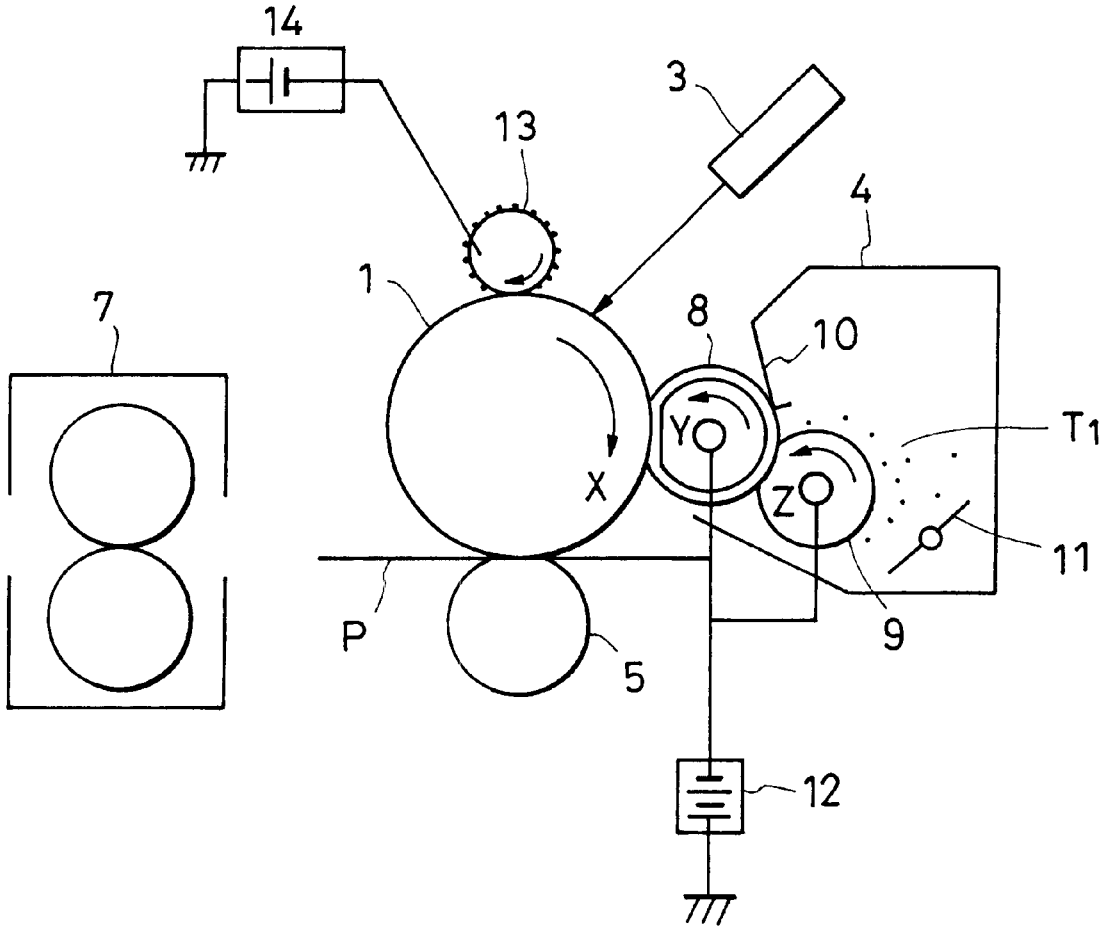
FIG. 6 is a schematic diagram of an image forming apparatus employing a development-and-cleaning system.

An image forming apparatus shown in FIG. 6 employs a developing-and-cleaning system and a direct injection charging method.

In FIG. 6, numeral 13 represents an elastic roller (hereinafter referred to as a charging roller) as a charging member which is brought into contact with a photosensitive drum 1 with a predetermined pressure and which is composed of a conductive sponge member.

The charging roller 13 holds (bears) conductive particles z on the periphery, and the conductive particles z fed by a development unit 4 via a development roller 8 intervene at the abutting section (hereinafter referred to as a charging nip) between the photosensitive drum 1 and the charging roller 13. Therefore, a nonmagnetic single component developer (toner) T1, which is contained in the development unit 4, includes toner particles, an external additive, and the conductive particles z.

The charging roller 13 is rolled by a drive (not shown in the drawing) in a direction opposite to the rolling direction of the photosensitive drum 1, and is brought into contact with the surface of the photosensitive drum 1 by a differential velocity. When a printer image is formed, a predetermined charging bias is applied to the charging roller 13 by a charging bias power source 14. Thus, the surface of the photosensitive drum 1 is contact-charged at predetermined polarity and potential using a direct charging (injection charging) method.

In this embodiment, by applying a DC voltage of −700 V to the charging roller 13 by the charging bias power source 14, the surface of the photosensitive drum 1 is directly charged at a voltage that is substantially equal to the applied DC voltage (i.e., approximately −700 V).

In this embodiment, as the conductive particles z, zinc oxide having a resistivity of approximately $10^6$ Ω·cm and an average particle size of approximately 1 μm is used.

In the development unit 4 in this embodiment, toner T1 containing the conductive particles z is supported by the development roller 8, the toner T1 is transferred to the photosensitive drum 1 by a development bias applied by a development bias power source 12, and an electrostatic latent image is developed. At this stage, since the development roller in accordance with the present invention is used, charge injection to the photosensitive drum 1 in the development process is inhibited. Consequently, the electrostatic latent image is not disturbed at the abutting section between the photosensitive drum 1 and the development roller 8, and even when an image with highlights is output, occurrence of unevenness in the image can be suppressed. Furthermore, since the development roller 8 includes an electron-conductive layer on a conductive core bar and an ion-conductive layer on the electron-conductive layer, changes in image density with image width do not occur, as was the case in the previous embodiment. A toner image is formed on the photosensitive drum 1 in a manner similar to that in the previous embodiment, and the image is transferred to a transfer member P in the transfer process.

Additionally, the toner remaining on the surface of the photosensitive drum 1 after the image transfer is conveyed to the charging nip between the photosensitive drum 1 and the charging roller 13 due to the rotation of the photosensitive drum 1, and the conductive particles z are fed to the charging nip and also are applied to the charging roller 13. That is, while the conductive particles z are present in the charging nip between the photosensitive drum 1 and charging roller 13, the photosensitive drum 1 is contact-charged.

Additionally, since the image forming apparatus in this embodiment employs a cleanerless structure, a cleaning device, such as a cleaning blade, is not provided. The toner remaining on the surface of the photosensitive drum 1 after the toner image is transferred to the transfer member P reaches the developing section through the charging process as the photosensitive drum 1 rotates, and development-and-cleaning are performed by the development unit 4, and thus the remaining toner is recovered and reused.

Next, the development-and-cleaning process will be described with reference to FIG. 7.

Figure 7:
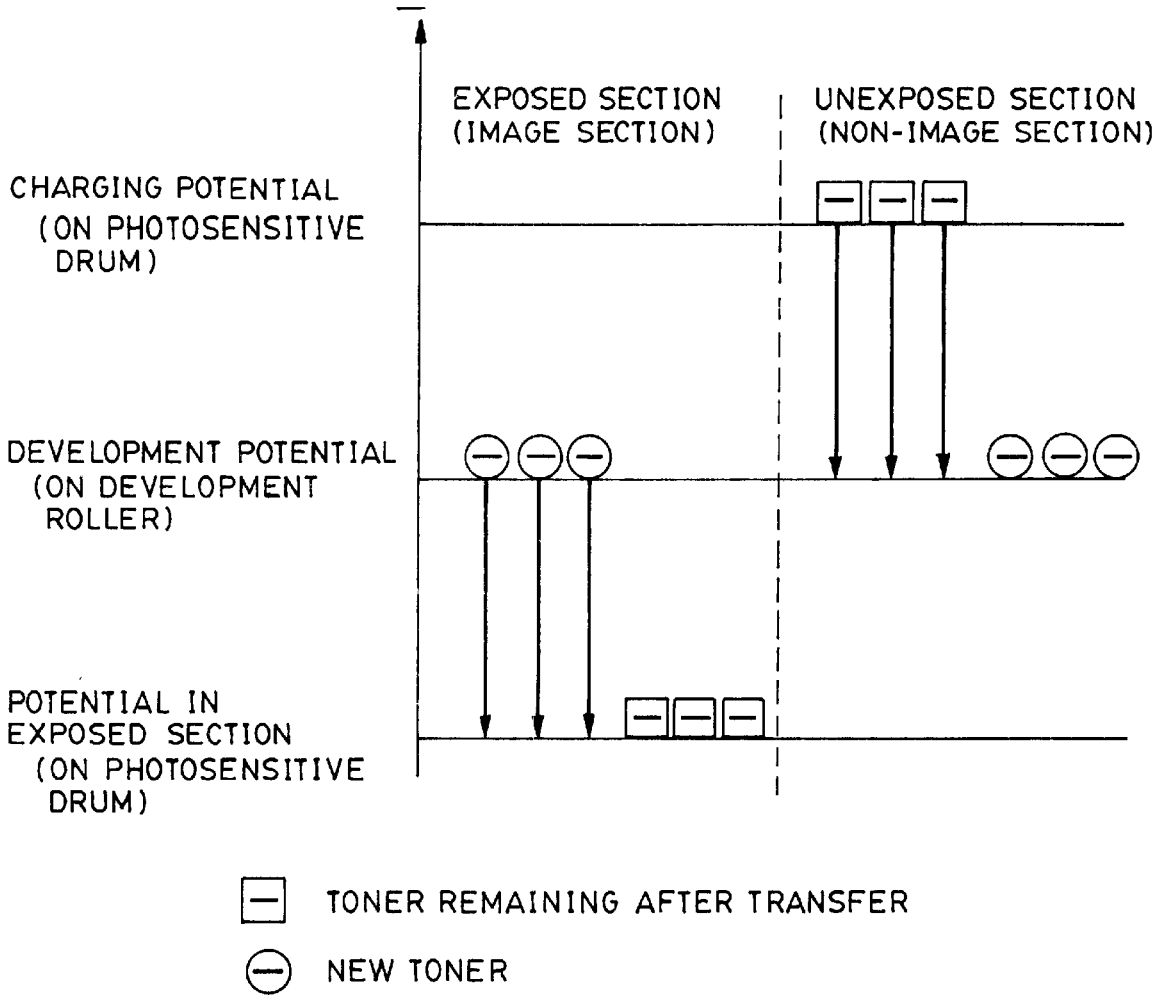
FIG. 7 is a schematic diagram which illustrates the principle of the development-and-cleaning system.

In FIG. 7, the symbol □ represents toner remaining after the image transfer lying on the surface of the photosensitive drum 1, and the symbol ○ represents new toner supported on the development roller 8 fed through the development blade. The mark "−" in the symbol indicates the charging polarity of the toner.

The toner remaining after the image transfer, which is the toner remaining on the surface of the photosensitive drum 1 without being transferred to the transfer member P in the transfer process, is charged at the charging potential in the non-image section due to friction with the photosensitive drum 1 and the charging roller 13 as well as the action of the conductive particles at the abutting section between the photosensitive drum 1 and the charging roller 13. The potential in the exposed section (image section) on the photosensitive drum 1 becomes −120 V in the subsequent exposure process. Furthermore, in the development process, the toner remaining after the image transfer in the exposed section continues to remain on the photosensitive drum 1, and also new toner supported by the development roller 8 is fed to the exposed section (i.e., development is performed) due to a potential difference of 230 V between a developing bias of −350 V and the potential in the exposed section. Simultaneously, the negatively charged toner remaining after the image transfer is moved onto the development roller 8 due to a potential difference between the charging potential on the photosensitive drum 1 (approximately −700 V) and the development bias (−350 V). At this stage, the new toner supported by the development roller 8 continues to remain on the development roller 8, and thus the development-and-cleaning process is carried out.

In the development-and-cleaning process, preferably, the charging potential and the development bias are set so that the back contrast (the absolute value of the potential difference between the charging potential and the development bias) is in the range of 150 to 600 V, and preferably, 250 to 500 V.

The charging roller 13 in this embodiment will now be described in detail. The charging roller 13 is fabricated by forming an expanded semiconductor layer composed of a resin (e.g., an urethane resin), conductive particles (e.g., carbon black), a sulfurizing agent, a foaming agent, etc., on a core bar in the shape of a roller.

The charging roller 13 in this embodiment has a roller resistance of 10 kΩ. The roller resistance is measured by the same method as that used for measuring the resistance of the development roller.

The conductive particles z used in this embodiment will now be described in detail.

As the material for the conductive particles z, various types of conductive particles may be used. Examples thereof are conductive inorganic particles made of metal oxides, such as aluminum oxide, titanium oxides, tin oxides, and zinc oxide, and mixtures of the above inorganic particles and organic substances, optionally, which may be subjected to surface treatment.

The resistance of the conductive particles is calculated as a resistivity by a method described below. Approximately 0.5 g of a powdered sample is placed in a cylinder having a bottom area of 2.26 $cm^2$, and the resistance is measured while applying a pressure of 15 kg and applying a voltage of 100 V between the top and bottom electrodes, followed by normalization. The resistivity of the conductive particles z calculated as described above is preferably $10^{10}$ Ω·cm or less because charge transfer is performed by means of the conductive particles z.

With respect to the particle size of the conductive particles z, 100 particles or more are sampled using an optical or electron microscope, a particle volume distribution is calculated based on a maximum arc distance in the horizontal direction, and the particle size is determined based on the 50% average particle size.

The particle size of the conductive particles z measured as described above is preferably 0.1 to 3 μm so that the conductive particles z act as microcarriers or spacer carriers. If the particle size is less than 0.1 μm, the conductive particles easily adhere to toner particles having a common particle size and follows the behavior of the toner, and thus the action as the spacer carriers is weakened. On the other hand, if the particle size exceeds 3 μm, the conductive particles lie among the toner particles, and it becomes difficult for the conductive particles to be sufficiently brought into contact with the toner, and therefore the toner is not easily charged.

Additionally, the conductive particles z may be in the state of primary particles or may also be in the state of aggregated particles. Even in any state of cohesion, as long as the function as the conductive particles is carried out, the state of the conductive particles does not matter.

Considering that the conductive particles are partially transferred to the recording member P from the photosensitive drum 1, in particular, in a full color image forming apparatus, color reproducibility may be impaired unless white or substantially transparent particles are used. Moreover, when the conductive particles are used for charging the photosensitive member, it is important not to disturb latent image exposure, i.e., not to block light, and in this respect, it is also preferable that white or substantially transparent particles be used. Nonmagnetic conductive particles are also preferred.

The amount of the conductive particles z to be mixed is set at 0.01 to 10 parts by mass relative to 100 parts by mass of the toner particles, and preferably, at 0.05 to 5 parts by mass.

If the content of the conductive particles z is less than 0.01 parts by mass, the amount of the conductive particles z to be fed to the charging roller 13 becomes too small, and it is not possible to ensure charging characteristics. If the content of the conductive particles z exceeds 10 parts by mass, excessive amounts of conductive particles z adhere to the photosensitive drum 1 and the development roller 8, thus degrading charging characteristics imparted to the toner or disturbing the image.

As described above, in the cleanerless image forming apparatus employing the direct injection charging method, by using the development roller, as the developer bearing member, including the conductive core bar, the electron-conductive layer, and the ion-conductive layer, it is also possible to form an image without a change in image density while preventing charge injection from the developer bearing member to the image bearing member even in the cleanerless image forming apparatus employing the direct injection charging method.

The present invention will be described in more detail based on examples.

Development rollers described below were fabricated experimentally and images were output in an image forming apparatus.

Fabrication of Development Roller (Example 1)

A development roller 1 was fabricated in the following manner. On a stainless steel core bar having a diameter of 8 mm, a solid silicone rubber layer, in which 15 parts by mass of carbon black relative to 100 parts by mass of the silicone rubber were dispersed, was formed as an electron-conductive layer at a thickness of 4 mm. As an ion-conductive layer, a polyamide resin, to which 1 part by mass of lithium perchlorate relative to 100 parts by mass of the polyamide resin was dispersed, was formed thereon at a thickness of 10 μm, and thus the elastic development roller 1 having a diameter of 16 mm was formed. The development roller 1 had an Asker C hardness of 42 degrees.

With respect to the surface roughness of the development roller 1, the ten-point average roughness Rz was 7.2 μm.

Before forming the ion-conductive layer, the development roller 1 had resistances of $6.2\times10^3$ Ω (200 V applied), $9.4\times10^3$ Ω (100 V applied), and $4.6\times10^4$ Ω (30 V applied), and after coating, resistances of $1.2\times10^8$ Ω (200 V applied), $3.2\times10^8$ Ω (100 V applied), and $5.9\times10^8$ Ω (30 V applied).

Fabrication of Development Roller (Comparative Example 1)

A development roller 2 as the one described in the Related Art was fabricated as follows. On a stainless steel core bar having a diameter of 8 mm, a solid silicone rubber layer, in which 4 parts by mass of carbon black were dispersed relative to 100 parts by mass of a silicone rubber, was formed as an electron-conductive layer at a thickness of 4 mm. With respect to the surface roughness of the development roller 2, the ten-point average roughness Rz was 6.8 μm. The resistances were $7.9\times10^6$ Ω (200 V applied), $4.8\times10^7$ Ω (100 V applied), and $8.6\times10^8$ Ω (30 V applied).

Fabrication of Development Roller (Comparative Example 2)

A development roller 3 was fabricated by forming an NBR layer, in which 2.5 parts by mass of a quaternary ammonium salt relative to 100 parts by mass of an NBR were dispersed, as an ion-conductive layer at a thickness of 4 mm on stainless steel core bar having a diameter of 8 mm. The surface roughness in terms of the ten-point average roughness Rz was 8.6 μm. The resistances were $7.6\times10^7$ Ω (200 V applied), $8.0\times10^7$ Ω (100 V applied), and $9.0\times10^7$ Ω (30 V applied).

Fabrication of Development Roller (Example 2)

A development roller 4 was fabricated in a manner similar to that in Example 1 apart from the fact that the thickness of the ion-conductive layer was set at 38 μm.

With respect to the surface roughness of the development roller 4, the ten-point average roughness Rz was 5.4 μm.

Before forming the ion-conductive layer, the development roller 4 had resistances of $6.2\times10^3$ Ω (200 V applied), $9.4\times10^3$ Ω (100 V applied), and $4.6\times10^4$ Ω (30 V applied), and after coating, resistences of $2.6\times10^7$ Ω (200 V applied), $4.8\times10^7$ Ω (100 V applied), and $7.6\times10^7$ Ω (30 V applied).

Next, on the image forming apparatus provided with a development blade (a stainless steel plate having a thickness of 0.1 mm) and a photosensitive drum (with a diameter of 30 mm), the development roller described above was mounted. In the image forming apparatus, the linear pressure between the development roller and the development blade was set at 28 g/cm, and the linear pressure between the development roller and the photosensitive drum was set at 35 g/cm.

Toner particles produced by suspension polymerization, having a shape factor SF-1 of 112, a shape factor SF-2 of 116 and a core/shell structure enclosing wax were used as the developer, to which 1 part by mass of hydrophobic silica fine particles as an external additive relative to 100 parts by mass of the toner particles was added.

Figure 4:
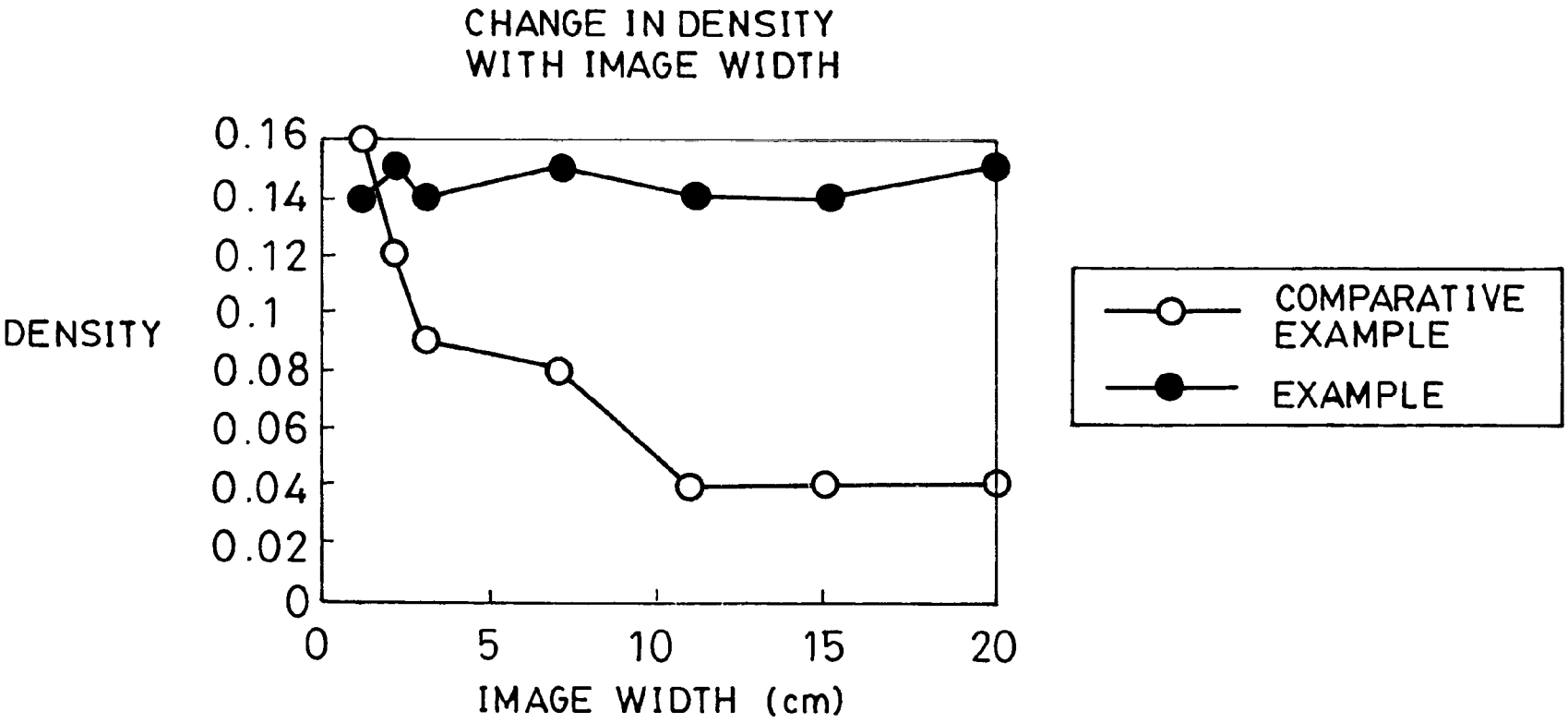
FIG. 4 is a graph which shows changes in image density with image width.
Figure 5:
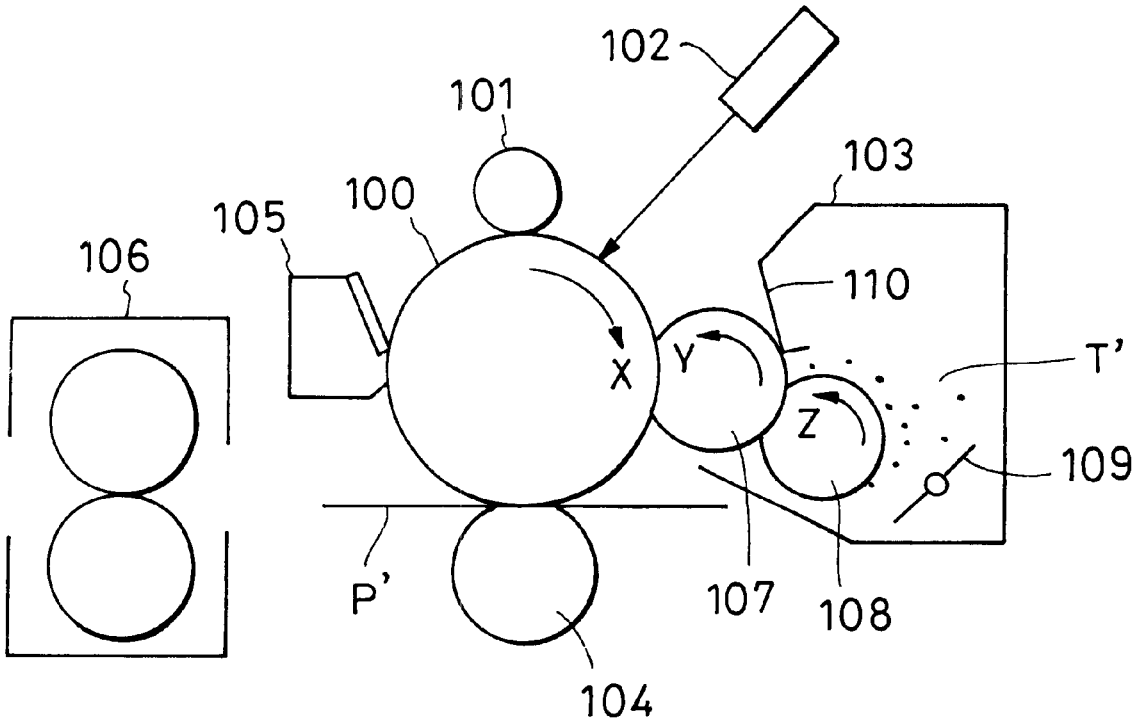
FIG. 5 is a schematic diagram of a conventional image forming apparatus.

Using the image forming apparatus and the toner described above, an image in which only one dot was switched on among a set of multiple pixels (4×4) at an output of 600 dpi was printed out under normal temperature and normal humidity conditions (24° C./55% RH), and changes in image density with image width were investigated. The results thereof are shown in FIG. 4.

In the image forming apparatus using the development roller 1 of the present invention, there was substantially no change in image density with image width. In contrast, in the image forming apparatus using the development roller 2, as the image width was increased, the image density was decreased. In image forming apparatuses using the development rollers 3 and 4, there was substantially no change in image density with image width. FIG. 4 shows changes in image density with image width when the development rollers 1 and 2 were used.

Furthermore, under low temperature and low humidity conditions (14° C./11% RH), a solid image was printed out using the image forming apparatus. When the development roller 3 was used, the image having a desired image density was not obtained. By measuring the resistance of the retrieved development roller 3, $6.4\times10^9$ Ω (200 V applied), $5.3\times10^9$ Ω (100 V applied), and $3.2\times10^9$ Ω (30 V applied) were obtained, which were higher than the resistances under normal temperature and normal humidity conditions. In the development roller 4, although slightly, a similar tendency was recognized, and a slight decrease in image density was observed.

In another experiment, the apparatus shown in FIG. 6 employing the development-and-cleaning system was used, and as a developer, the developer used in the above example was used to which 2.5 parts by mass of zinc oxide particles relative to 100 parts by mass of toner particles were added as conductive particles.

The development roller 1 and a development roller 5 fabricated as described below were prepared.

Fabrication of Development Roller (Example 3)

A development roller 5 was fabricated in a manner similar to that in Example 1 apart from the fact that the amount of lithium perchlorate dispersed in the ion-conductive layer was set at 1.8 parts by mass relative to 100 parts by mass of the polyamide resin.

With respect to the surface roughness of the development roller 5, the ten-point average roughness Rz was 7.6 μm.

Before forming the ion-conductive layer, the development roller 5 had resistances of $6.2\times10^3$ Ω (200 V applied), $9.4\times10^3$ Ω (100 V applied), and $4.6\times10^4$ Ω (30 V applied), and after coating, resistences of $2.6\times10^6$ Ω (200 V applied), $3.8\times10^6$ Ω (100 V applied), and $5.6\times10^6$ Ω (30 V applied).

An image with highlights was output using the image forming apparatus and the developer described above. When the development roller 1 was used, a satisfactory image was obtained without unevenness in image density, and cleaning was also performed satisfactorily, and thus excellent results were obtained.

When the development roller 5 was mounted on the apparatus and an image with highlights was similarly output, a satisfactory image was obtained without unevenness in image density, the same as the development roller 1.

Next, a solid image was output, using the image forming apparatus on which the development roller 1 or the development roller 5 was mounted. When the development roller 1 was used, the maximum image density was 1.44, and when the development roller 5 was used, the maximum image density was 1.56. That is, when the development roller 5 was used, the color reproducibility range was wider and the higher quality image was reproducible in comparison with the development roller 1.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member for bearing an electrostatic latent image;

a charging device for charging the surface of the image bearing member;

an electrostatic latent image forming device for forming the electrostatic latent image on the surface of the image bearing member charged by the charging device;

a developing device, comprising a developer bearing member for bearing a single component developer, for performing development by bringing the single component developer into contact with the electrostatic latent image to form a visible image;

a transfer device for electrostatically transferring the visible image to a transfer member; and a fixing device for fixing the electrostatically transferred visible image on the transfer member, wherein the developer bearing member comprises a conductive core bar, an electron-conductive layer comprising an elastic body, and an ion-conductive layer, and wherein the developer bearing member comprises the electron-conductive layer on the conductive core bar and the ion-conductive layer on the electron-conductive layer.

2. The image forming apparatus according to claim 1, wherein the electron-conductive layer has a resistance in the range of $1\times10^3$ to $1\times10^5$ Ω.

3. The image forming apparatus according to claim 1, wherein the electron-conductive layer has a resistance in the range of $5\times10^3$ to $7\times10^4$ Ω.

4. The image forming apparatus according to claim 1, wherein a conductivity-imparting agent is dispersed in the electron-conductive layer and the conductivity-imparting agent comprises carbon black.

5. The image forming apparatus according to claim 1, wherein the electron-conductive layer comprising the elastic body includes a silicone rubber having carbon black dispersed therein.

6. The image forming apparatus according to claim 1, wherein the developer bearing member has a resistance in the range of $5\times10^5$ to $1\times10^9$ Ω.

7. The image forming apparatus according to claim 1, wherein the developer bearing member has a resistance in the range of $1\times10^6$ to $1\times10^9$ Ω.

8. The image forming apparatus according to claim 1, wherein the developer bearing member has a resistance in the range of $1\times10^6$ to $5\times10^7$ Ω.

9. The image forming apparatus according to claim 1, wherein the ion-conductive layer comprises a resin binder in which a conductivity-imparting agent having ionic conductivity is dispersed therein.

10. The image forming apparatus according to claim 1, wherein the ion-conductive layer has a thickness in the range of 3 to 50 μm.

11. The image forming apparatus according to claim 1, wherein the ion-conductive layer has a thickness in the range of 5 to 30 μm.

12. The image forming apparatus according to claim 1, wherein a resistance of the developer bearing member is at least 2 orders of magnitude higher than a resistance before the developer bearing member is coated with the ion-conductive layer.

13. The image forming apparatus according to claim 1, wherein the single component developer includes toner particles and an external additive.

14. The image forming apparatus according to claim 13, wherein the toner particles have a shape factor SF-1 in the range of 100 to 160 and a shape factor SF-2 in the range of 100 to 140.

15. The image forming apparatus according to claim 13, wherein the toner particles have a core/shell structure.

16. The image forming apparatus according to claim 13, wherein the toner particles are produced by suspension polymerization.

17. The image forming apparatus according to claim 1, wherein a linear abutting pressure between the developer bearing member and the image bearing member is in the range of 20 to 100 g/cm.

18. The image forming apparatus according to claim 1, wherein a development contrast is in the range of 100 to 400 V.

19. The image forming apparatus according to claim 1, further comprising a development-and-cleaning system for recovering toner, which remains on the surface of the image bearing member after the visible image is transferred to the transfer member, by the developer bearing member.

20. The image forming apparatus according to claim 19, wherein a back contrast is in the range of 150 to 600 V.

* * * * *

UNITED STATES PATENT AND TRADEMARK OFFICE

CERTIFICATE OF CORRECTION

PATENT NO. : 6,397,032 B1 
DATED : May 28, 2002
INVENTOR(S) : Katsuhiro Sakaizawa et al.

It is certified that error appears in the above-identified patent and that said Letters Patent is hereby corrected as shown below:

Column 2,
Line 12, “born” should read -- borne --;
Line 28, “fixing by” should read -- being fixed by --.

Column 9,
Line 37, “polyacryresinesins,” should read -- polyacrylic resins, --.

Column 16,
Line 24, “fixing” should read -- being fixed --.

Signed and Sealed this

Nineteenth Day of November, 2002

*Attest:*

*Attesting Officer*

JAMES E. ROGAN
*Director of the United States Patent and Trademark Office*